US007490628B2

(12) United States Patent
Frost et al.

(10) Patent No.: US 7,490,628 B2
(45) Date of Patent: Feb. 17, 2009

(54) MANIFOLD AND VALVE ASSEMBLY

(75) Inventors: Timothy Lee Frost, Cleveland, TN (US); Ian Rodgers, Chattanooga, TN (US); Daryl Williams, Chattanooga, TN (US); Richard Cowan, Chattanooga, TN (US)

(73) Assignee: Burner Systems International, Inc., Chattanooga, TN (US)

( * ) Notice: Subject to any disclaimer, the term of this patent is extended or adjusted under 35 U.S.C. 154(b) by 256 days.

(21) Appl. No.: 11/512,901

(22) Filed: Aug. 30, 2006

(65) Prior Publication Data

US 2007/0044786 A1 Mar. 1, 2007

Related U.S. Application Data

(60) Provisional application No. 60/712,493, filed on Aug. 30, 2005.

(51) Int. Cl.
*F16K 11/20* (2006.01)

(52) U.S. Cl. ..... 137/883; 137/318; 126/39 N

(58) Field of Classification Search ..... 137/317, 137/318, 320, 323, 374, 883; 126/39 R, 126/39 N; 285/197
See application file for complete search history.

(56) References Cited

U.S. PATENT DOCUMENTS

| | | | | |
|---|---|---|---|---|
| 1,925,810 | A * | 9/1933 | Maul | 126/39 N |
| 2,039,652 | A * | 5/1936 | Leonard | 126/39 N |
| 2,626,634 | A * | 1/1953 | McDowell | 137/883 |
| 3,602,480 | A * | 8/1971 | Demi | 285/197 |
| 3,870,348 | A * | 3/1975 | Hawkins | 285/197 |
| 5,979,430 | A * | 11/1999 | Peed et al. | 126/39 N |
| 6,722,356 | B2 * | 4/2004 | Distaso | 126/39 N |
| 7,299,799 | B2 * | 11/2007 | Albizuri | 126/39 N |
| 7,322,616 | B2 * | 1/2008 | Lang | 285/197 |

* cited by examiner

*Primary Examiner*—John Fox
(74) *Attorney, Agent, or Firm*—Stephen J. Stark; Miller & Martin PLLC

(57) ABSTRACT

A semi-flexible tube is captured between a valve body and a connection device wherein at least one of the valve body and the connection device is connected structurally to a range instead of relying on the manifold tube as the location mechanism for precisely locating the valve at a desired location on the range.

20 Claims, 6 Drawing Sheets

PRIOR ART

MANIFOLD AND VALVE ASSEMBLY

CLAIM OF PRIORITY

This application claims the benefit of U.S. Provisional patent application Ser. No. 60/712,493 filed Aug. 30, 2005.

FIELD OF THE INVENTION

The present invention relates to a method and apparatus for joining a valve to a manifold assembly and the valve and manifold assembly once constructed.

DESCRIPTION OF RELATED ART

In gas ranges as known by the applicant, valves are attached to a manifold constructed of steel or other rigid material. The rigidity of the manifold material is useful in that the manifold is useful to determine the position of (i.e., locate) valves in various appliances such as gas ranges. The accurate positioning alignment of valves in the appliance is usually a very important characteristic in demonstrating the quality of the appliance.

FIGS. 1-4 are provided which show two prior art manifold valve constructions. FIGS. 1 and 2 show a square manifold with a hole which has been machined into two opposing sides of the manifold. A valve inlet stem with internal threads passes through one wall of the square tube. A screw is then inserted through an opposite wall of the square tube and engages the threads in the valve stem. The screw can then be tightened to seal gaskets beneath the screw head and at the valve body.

A second system as shown in FIGS. 3 and 4 involves a round manifold with a hole on one side of the manifold tube. A valve inlet stem is then inserted into the hole and the round tube. A bracket is then attached on opposite side of the tube and is secured to the valve by using a screw and hook configuration on the opposite side or a two screw system as illustrated. Sealing is usually accomplished by a gasket positioned between the valve body and the round manifold tube.

There is believed to be a number of drawbacks to these two current systems. Specifically, rigid manifolds are expensive to construct. Since the manifold is usually utilized as the positioning device for the valves, manifolds, holes and brackets included with the manifold must be accurately manufactured and precisely located. Rigidity of current manifold constructions make it expensive and difficult to position valves in creative locations on a range.

Accordingly, there is believed to be a need for an improved manifold and valve assembly as well as a new construction method.

SUMMARY OF THE INVENTION

Accordingly, it is an object of the present invention to provide a manifold and valve assembly which can be easily assembled.

It is another object of the present invention to provide a manifold and valve assembly which can be relatively inexpensively constructed.

It is another object of the present invention to provide a manifold and valve assembly that allows range manufacturers to position valves at a variety of locations with limited risk of improper valve alignment.

It is another object of at least some embodiments of the present invention to provide a manifold and valve assembly which does not necessarily require drilling of holes through the manifold before installing the valve thereto.

Accordingly, a system of the presently preferred embodiment includes one or more valves, one or more connection devices and an aluminum, copper, or other semi-flexible tube. The tube can be round or any other shape.

In the preferred embodiment, the semi-flexible tube is captured between a valve body and a connection device which could be connected to if not a portion of a structural member such as a piece of sheet metal. A portion of the valve such as a valve inlet stem may puncture through a portion of the tube. Of course, in other embodiments predrilled holes could be provided. Alignment of the valves can be determined by the structural member valve and/or connection device. In the prior art, separate brackets were required to connect the manifold to structural portions of the range. No portion of the valve or the valve connection system as can be seen in FIGS. 1-4 was connected to the range independent of the manifold.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
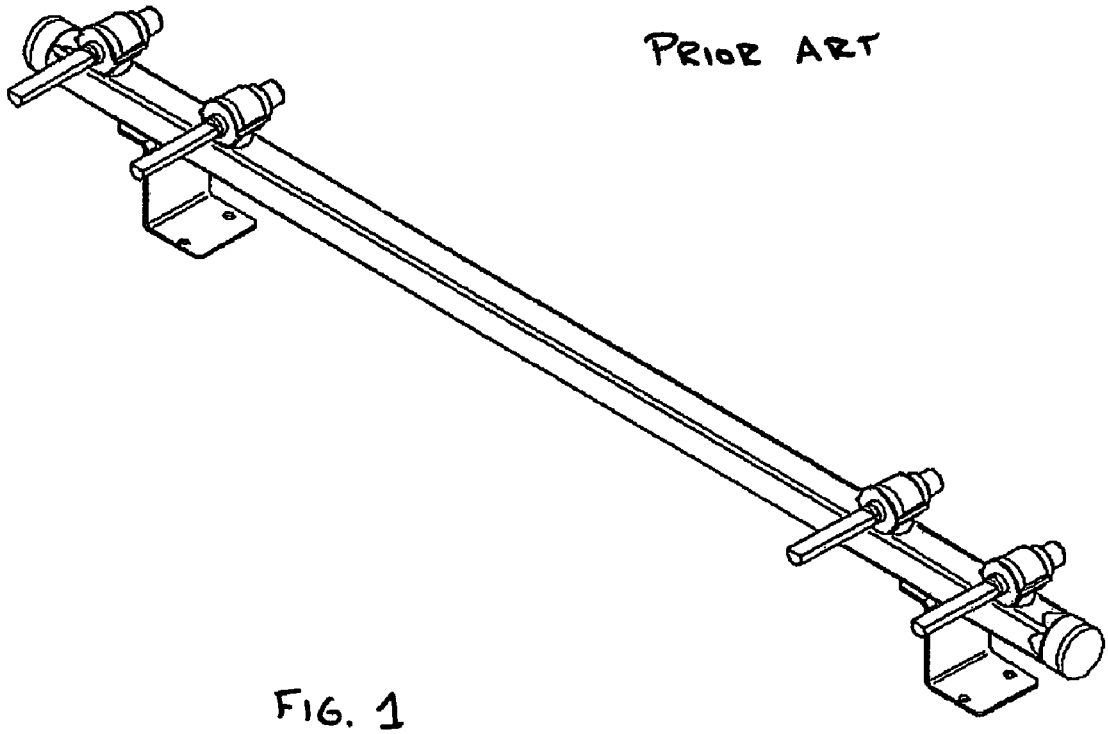
FIG. 1 is a top perspective view of a prior art manifold and valve arrangement.
Figure 2:
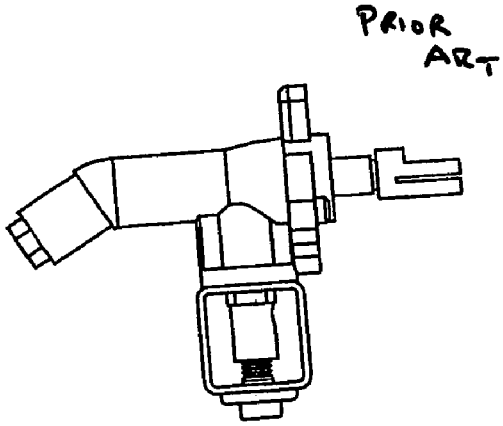
FIG. 2 is a cross-sectional view of a valve and manifold tube similar to the construction shown in FIG. 1.
Figure 3:
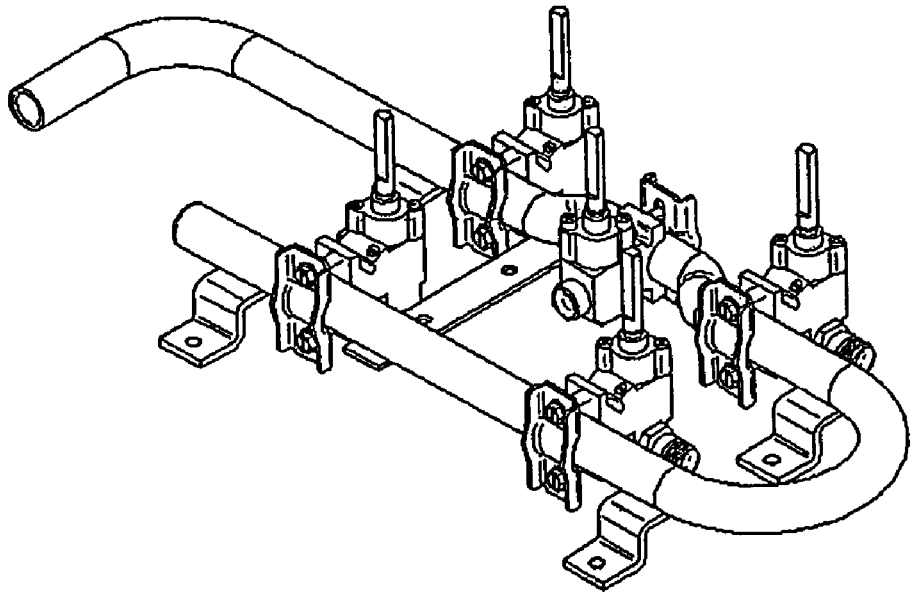
FIG. 3 PRIOR ART
FIG. 3 is a second prior art manifold and tube arrangement.
Figure 4:
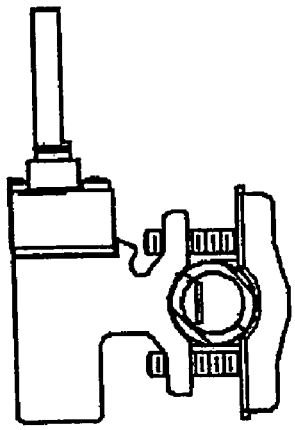
FIG. 4 is a cross-sectional view of a valve and a portion of the manifold tube shown in FIG. 3.
Figure 5:
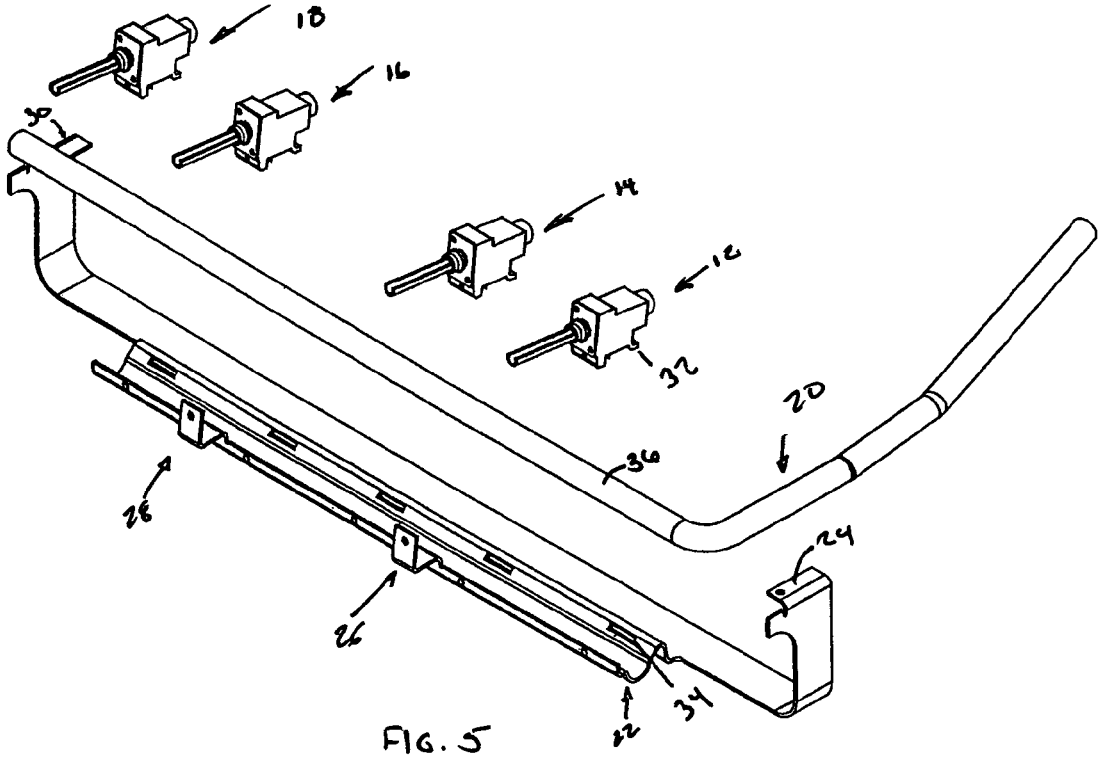
FIG. 5 is an exploded view of a presently preferred embodiment of the present invention of a manifold and valve assembly showing valves, a semi-flexible manifold tube and a capturing device of the presently preferred embodiment of the present invention.

FIGS. 5-12 show various views of presently preferred embodiments of the present invention of a manifold and valve assembly. Specifically, the preferred embodiment of FIGS. 5-8 will be discussed first. The manifold and valve assembly 10 shows a plurality of valves 12,14,16,18 which can be better seen in the exploded view of FIG. 5. Although four valves 12,14,16,18 are shown, it is possible to utilize similar construction techniques with a single valve or with any number of valves as would be understood by one of ordinary skill in the art.

A manifold tube 20 constructed of a semi-flexible material such as copper or aluminum is illustrated. Prior art manifold and valve construction are believed to rely on non-flexible stainless steel. In the prior art, the rigid manifold tube is believed to assist in precise valve placement. The use of a semi-flexible tube 20 is believed to provide a number of advantages which will be discussed below.

At least one capturing device 22 is illustrated. In the embodiment illustrated, a capturing device 22 provides a structural connection through brackets 24,26,28,30 to a portion of a range as would be understood by one of ordinary skill in the art. At least one of the valves 12,14,16,18 and at least one capturing device 22 are structurally connected to the gas appliance such as a range such as with brackets 24,26,28,30 as illustrated, although other connections could be provided as will be discussed in further detail below. These separate connections through the connection device 22 and/or valves 12 provide an ability to precisely locate the valves 12,14,16,18 as desired in precise location independent of precise location relative to the manifold tube 20 which was the prior art method of locating valves.

Figure 6:
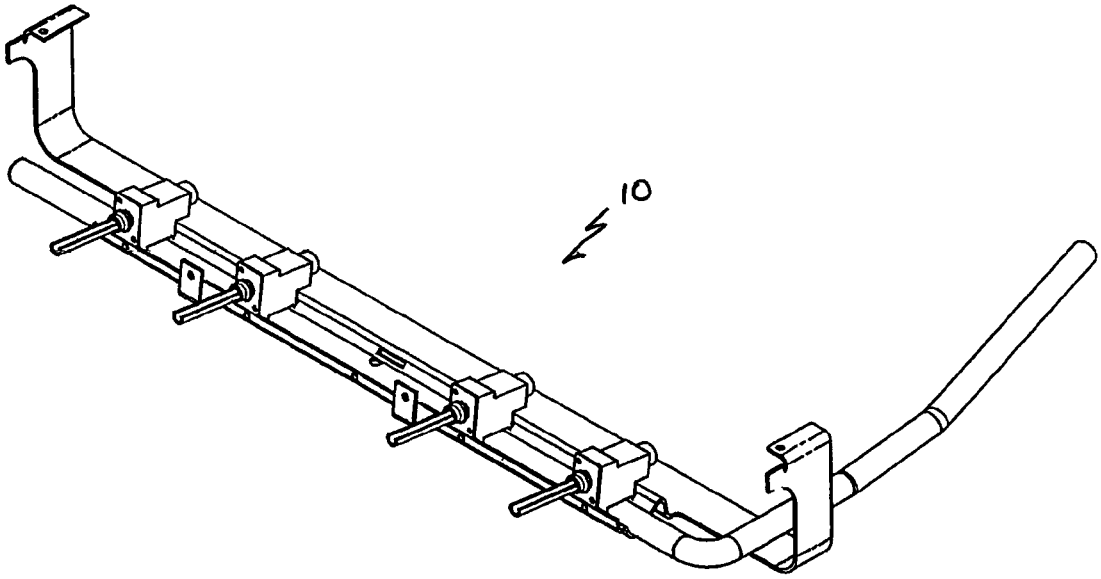
FIG. 6 is a top perspective assembled view of the components shown in FIG. 5.
Figure 7:
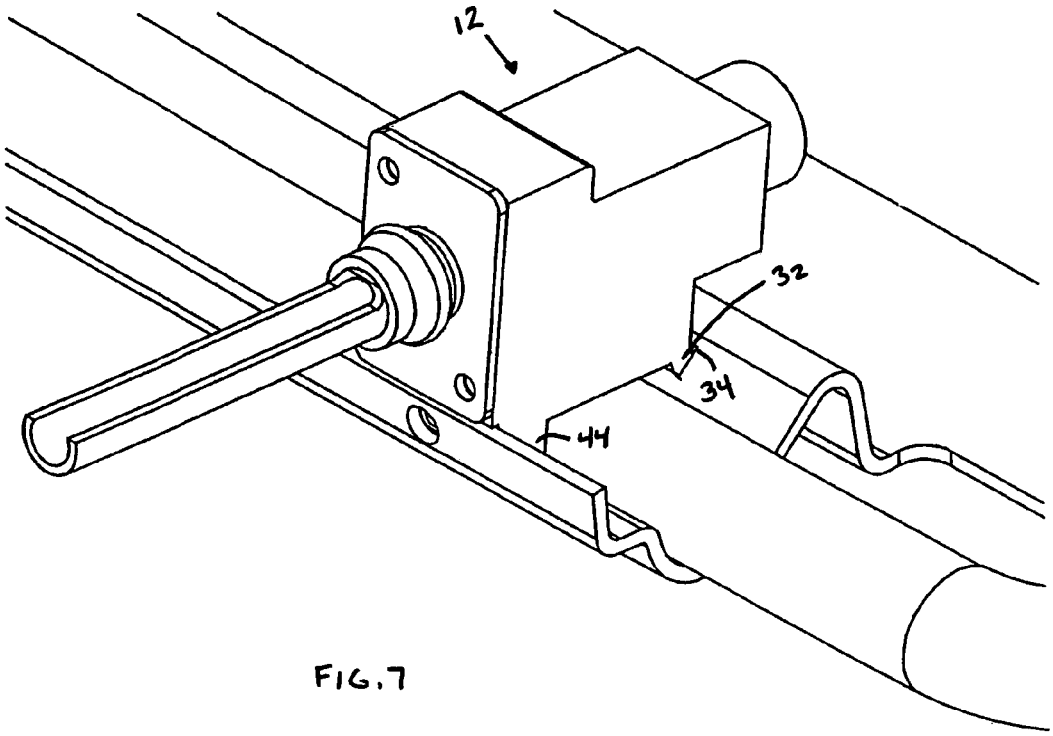
FIG. 7 is a detailed view of one of the valves of the manifold tube and a portion of the capturing device shown in FIG. 6.
Figure 8:
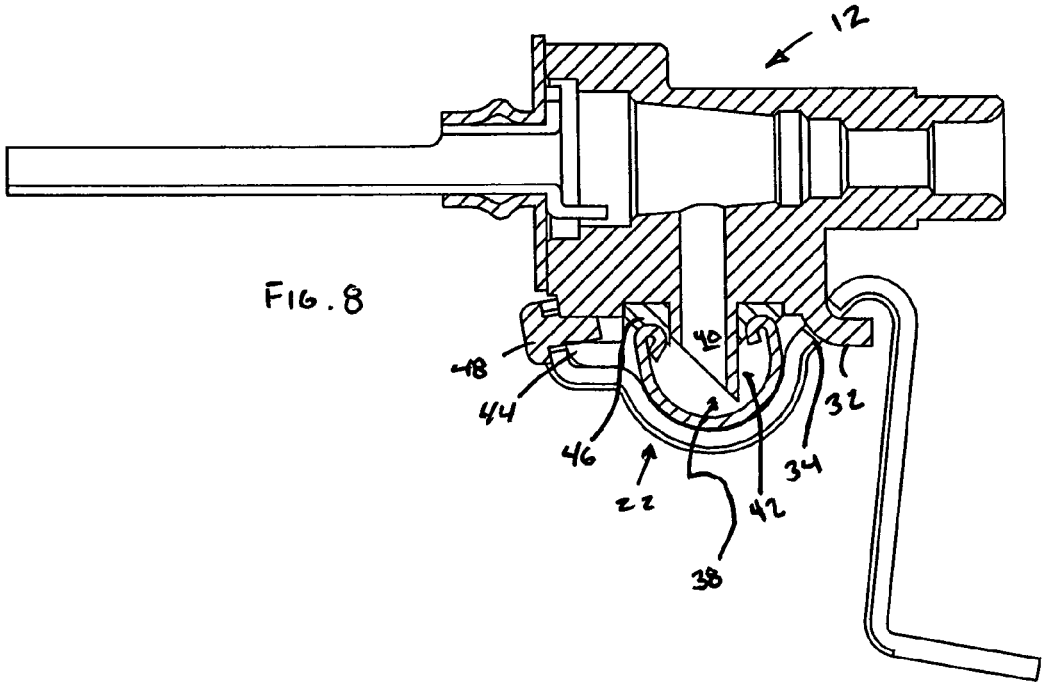
FIG. 8 is a cross sectional view taken across one of the valves as shown in FIG. 6 in the installed configuration with the manifold tube and the connection device.

In order to connect the parts shown in FIG. 6, respective valves have a foot 32. The foot 32 is placed in slot 34 in connection device 22 and then pushed downwardly so that a valve inlet stem 34 can puncture through an exterior surface portion 36 of the manifold tube 20 to provide a communication to the valve inlet 40 from a tube interior 38 as may best be visualized with reference to FIG. 8. The valve inlet 40 is illustrated as a portion of a valve inlet stem 42 which preferably extends deeper into the tube interior 38 towards the foot 32 then towards an arm 44 as illustrated. By providing this angle, the valve inlet stem 42 can even be utilized to punch through an otherwise non-penetrated exterior surface 36 of a semi-flexible manifold tube 20 so that the valve 12 can achieve communication through the manifold tube 20 as illustrated. Seal 46 is useful to assist in sealing. Connection screw 48 is useful to retain arm 46 in a position to connect the valve 12 to the connection device 22 especially with the foot 32 being housed in slot 34. Other connection mechanisms may be employed with other connection devices 22.

Once again, what separates this configuration prior art designs is that the connection device 22 and/or the valves 12,14,16,18 are connected structurally to the appliance apart from the manifold tube which is not done in prior art constructions. Brackets 24,26,28,30 extend from the connection device 22 as illustrated in FIG. 5-8 to affect such a construction.

Figure 9:
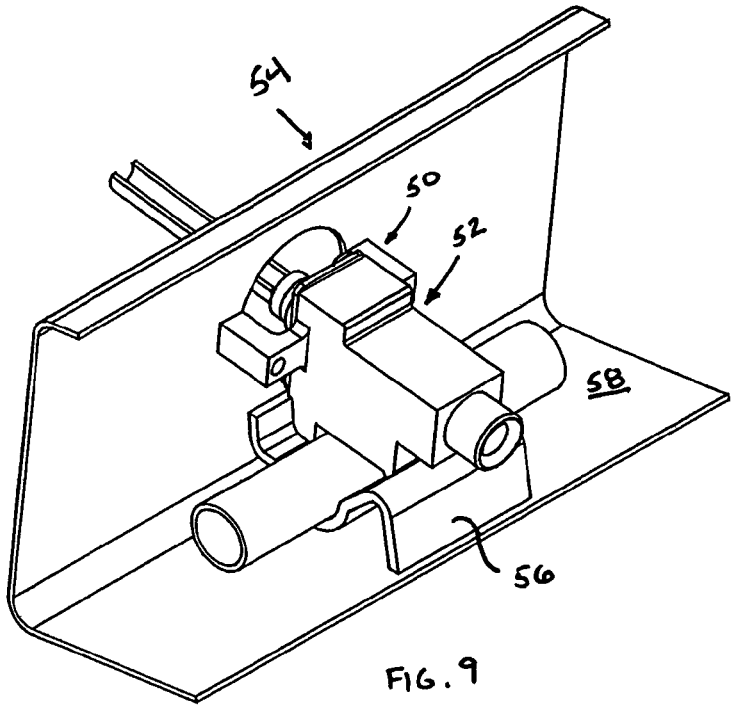
FIG. 9 is a first alternative preferred embodiment of a manifold and valve assembly.

FIG. 9 shows a first alternate embodiment of the presently preferred invention in that instead of having a connection device 56 connected directly to the structural valve positioning member 54, in this embodiment, the structural valve positioning member 50 is a bracket which connects to the valve 52 to allow precise flow from a valve relative to a front face 54 of a range (on a portion range 58 is provided for illustration clarity). Furthermore, connection device 54 may or may not be connected to a portion connected to the face 54 illustrated as bottom 58.

Figure 10:
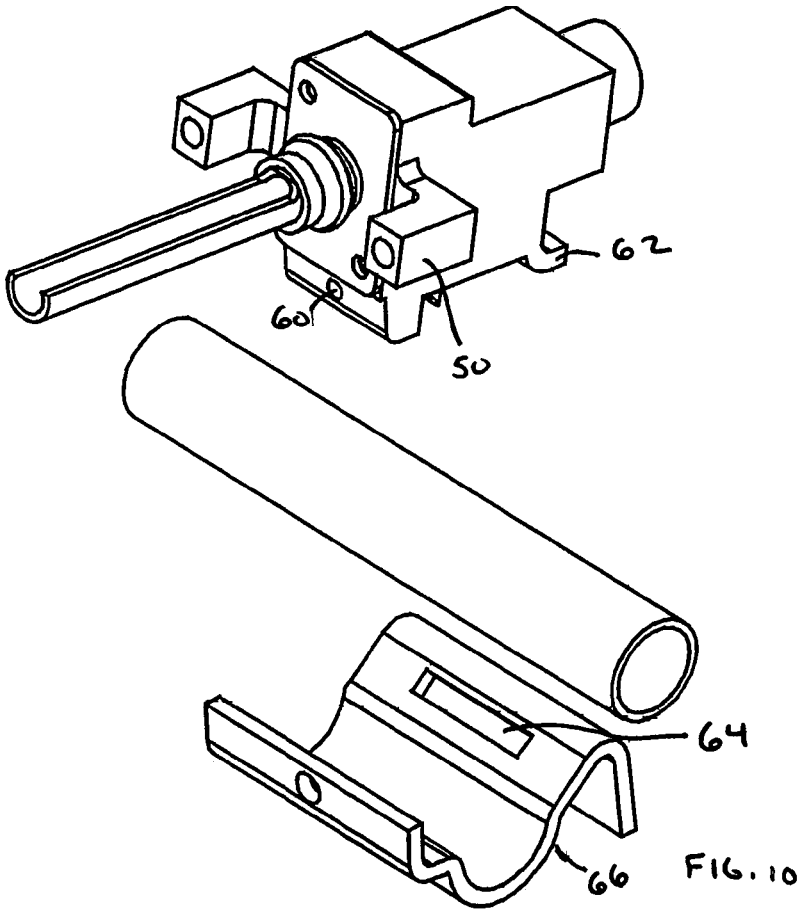
FIG. 10 is an exploded view of the alternative embodiment shown in FIG. 8.

FIG. 10 shows an exploded view showing the bracket 50 which forms structural valve positioning member. A screw bore (screw not shown through bore 60) assists with foot 62 and slot 64 in retaining the valve 52 in a desired relationship relative to the connection device 66 in a very similar manner as that shown for the embodiment of FIGS. 5-8. Other structures could be employed in other embodiments.

Figure 11:
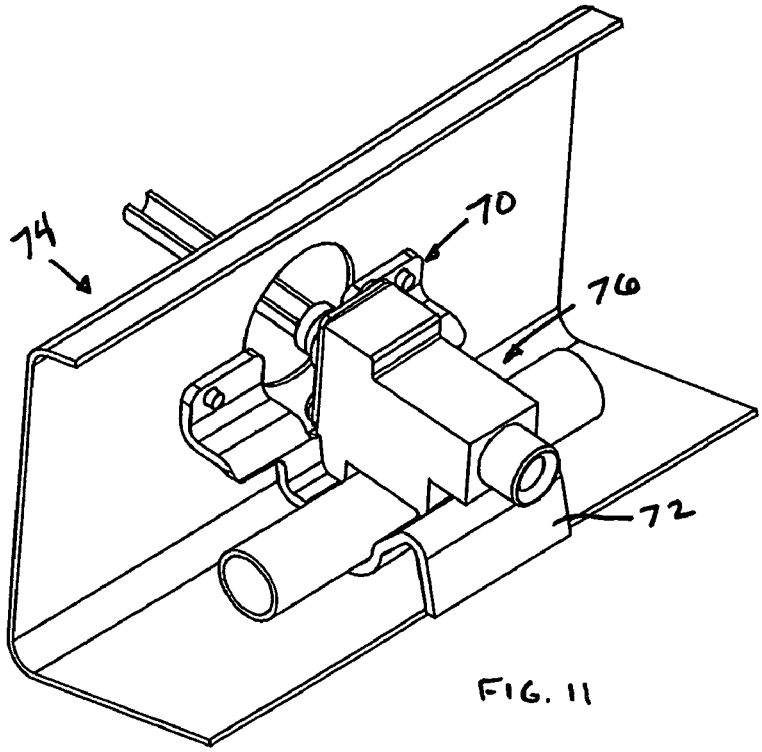
FIG. 11 is a second alternative embodiment of a manifold and valve assembly.
Figure 12:
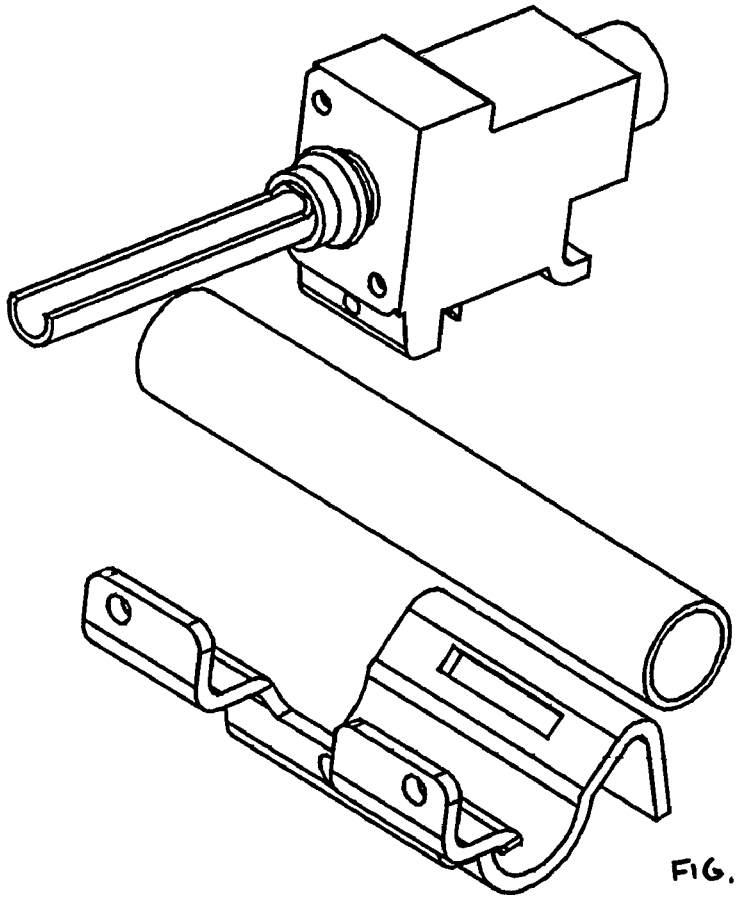
FIG. 12 is an exploded view of the components shown in FIG. 10.

In a second alternative embodiment shown in FIGS. 11-12, a bracket 70 is a portion of a connection device 72 and connects to the front face 74 to precisely locate valve 76 at a desired location as shown. FIG. 12 shows an exploded view of this embodiment.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, claimed herein is:

1. A manifold and valve assembly for use with a gas appliance comprising:

a gas valve having a valve inlet stem;

a manifold tube formed of a semi-flexible material; and a capturing device;

wherein a portion of the manifold tube is captured intermediate a portion of the gas valve and a portion of the capturing device with an inlet to the gas valve in communication with an interior of the manifold tube, and at least one of the capturing device and gas valve is structurally connected to the gas appliance separately from the manifold tube and assists in retaining the tube where captured relative to the gas appliance; and wherein said valve inlet stem punches through an exterior wall surface of the portion of the manifold tube during installation.

2. The manifold and valve assembly of claim 1 wherein the capturing device is a portion of a structural member of the gas appliance.

3. The manifold and valve assembly of claim 2 wherein the capturing device is a structural valve positioning device.

4. The manifold and valve assembly of claim 1 wherein the gas valve is connected to a structural valve positioning device.

5. The manifold and valve assembly of claim 4 further comprising two screws extending into the gas valve through the structural valve positioning device.

6. The manifold and valve assembly of claim 1 wherein the capturing device is a structural valve positioning device.

7. The manifold and valve assembly of claim 1 wherein the valve further comprises a foot which is received within a slot at a first portion of the capturing device and an arm which receives a connector which is inserted through a bore in a second portion of the capturing device spaced from the first portion.

8. The manifold and valve assembly of claim 7 a valve inlet stem is disposed about at least a portion of the valve inlet, and the valve inlet stem punches through an exterior wall surface of the portion of the manifold tube during installation in an absence of a pre-existing orifice through the exterior wall surface.

9. The manifold and valve assembly of claim 1 wherein the valve inlet stem is disposed about at least a portion of the valve inlet, and the valve inlet stem punches through an exterior wall surface of the portion of the manifold tube during installation in an absence of a pre-existing orifice through the exterior wall surface.

10. The manifold and valve assembly of claim 1 further comprising a plurality of gas valves and wherein the capturing device comprises a plurality of stations which respectively cooperate with respective gas valves.

11. A manifold and valve assembly for use with a gas appliance comprising:

a gas valve with an inlet stem;

a manifold tube; and a capturing device;

wherein a portion of the manifold tube is captured intermediate a portion of the gas valve and the capturing device with an inlet to the gas valve in communication with an interior of the manifold tube, and at least one of the capturing device and gas valve is rigidly and directly connected to the gas appliance at a location spaced from the manifold tube and assists with the gas valve in retaining the tube where captured relative to the gas appliance; and wherein the inlet stem punches through an exterior wall surface of the portion of the manifold tube during installation.

12. The manifold and valve assembly of claim 11 wherein the capturing device is a portion of a structural member of the gas appliance.

13. The manifold and valve assembly of claim 12 wherein the capturing device is a structural valve positioning device.

14. The manifold and valve assembly of claim 11 wherein the gas valve is connected to a structural valve positioning device.

15. The manifold and valve assembly of claim 11 wherein the capturing device is a structural valve positioning device.

16. The manifold and valve assembly of claim 11 wherein the valve further comprises a foot which is received within a slot at a first portion of the capturing device and an arm which receives a connector which is inserted through a bore in a second portion of the capturing device spaced from the first portion.

17. The manifold and valve assembly of claim 16 wherein the inlet stem is disposed about at least a portion of the valve inlet, and the inlet stem punches through an exterior wall surface of the portion of the manifold tube during installation in an absence of a pre-existing orifice through the exterior wall surface.

18. The manifold and valve assembly of claim 11 wherein the inlet stem is disposed about at least a portion of the valve inlet, and the inlet stem punches through an exterior wall surface of the portion of the manifold tube during installation in an absence of a pre-existing orifice through the exterior wall surface.

19. The manifold and valve assembly of claim 16 wherein the inlet stem extends further into the manifold tube toward the foot than toward the arm.

20. The manifold and valve assembly of claim 11 further comprising a plurality of gas valves and wherein the capturing device comprises a plurality of stations which respectively cooperate with respective gas valves.

* * * * *